US005881517A

United States Patent [19]

Prince et al.

[11] Patent Number: 5,881,517

[45] Date of Patent: Mar. 16, 1999

[54] REST ROOM PARTITION MOUNTING BRACKETS

[75] Inventors: Robert G. Prince; Scott A. Colley, both of Fort Wayne, Ind.

[73] Assignee: Universal Consolidated Methods, Inc., Topeka, Ind.

[21] Appl. No.: 934,001

[22] Filed: Aug. 26, 1997

[51] Int. Cl.[6] ..... E04B 1/38

[52] U.S. Cl. ..... 52/238.1; 52/241; 52/713; 52/584.1; 52/745.12; 52/745.21; 49/505; 248/274.1; 248/298.1

[58] Field of Search ..... 52/713, 716.8, 52/745.1, 745.12, 745.21, 36.5, 238.1, 239, 241, 584.1; 248/274.1, 298.1; 211/175, 201, 208; 49/505

[56] References Cited

U.S. PATENT DOCUMENTS 3,284,974 11/1966 Stein .

3,545,135 12/1970 Lieber .

*Primary Examiner*—Robert Canfield

*Attorney, Agent, or Firm*—Roger M. Rickert

[57] ABSTRACT

Rest room partition mounting brackets are formed from two of four possible extruded bracket halves which may be joined in pairs to form any of twelve different brackets for mounting rest room separating panels. The bracket halves are extrusions of generally uniform cross-sectional configuration, but have periodic screw-accepting holes and opposed periodic notches which notches are alignable with one another to form central mounting screw accepting apertures. By selecting two of four possible bracket halves, each of three different bracket configurations may be created. A simple U-shaped bracket, a U-shaped bracket with one outboard ear, or a U-shaped bracket with two outboard ears.

7 Claims, 4 Drawing Sheets

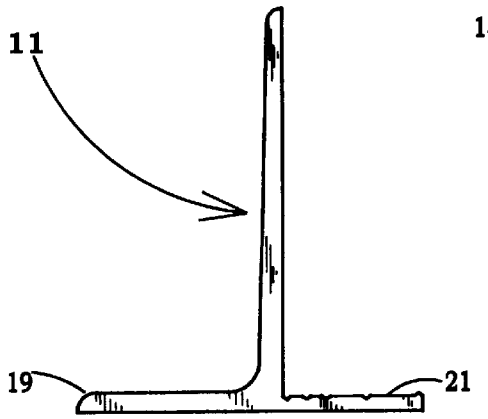
Fig. 1
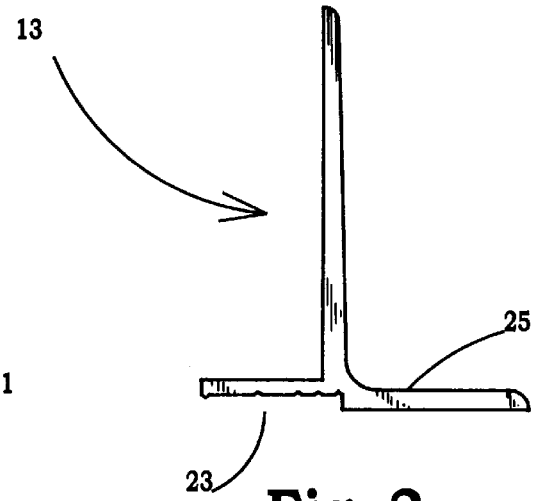
Fig. 2
Fig. 3
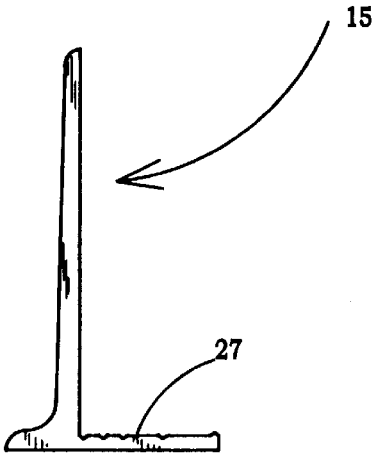
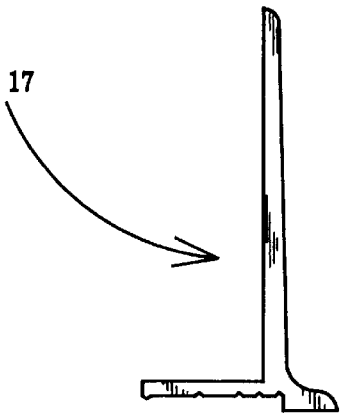
Fig. 4

Fig. 11a
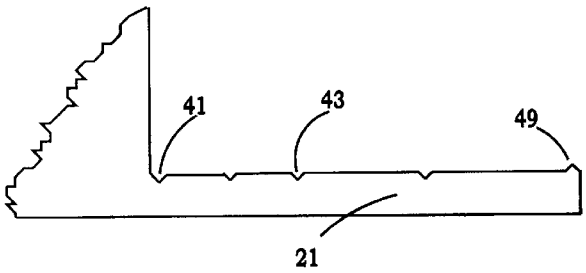
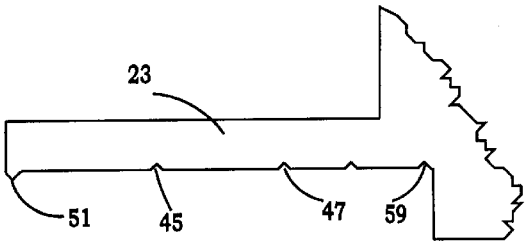
Fig. 11b
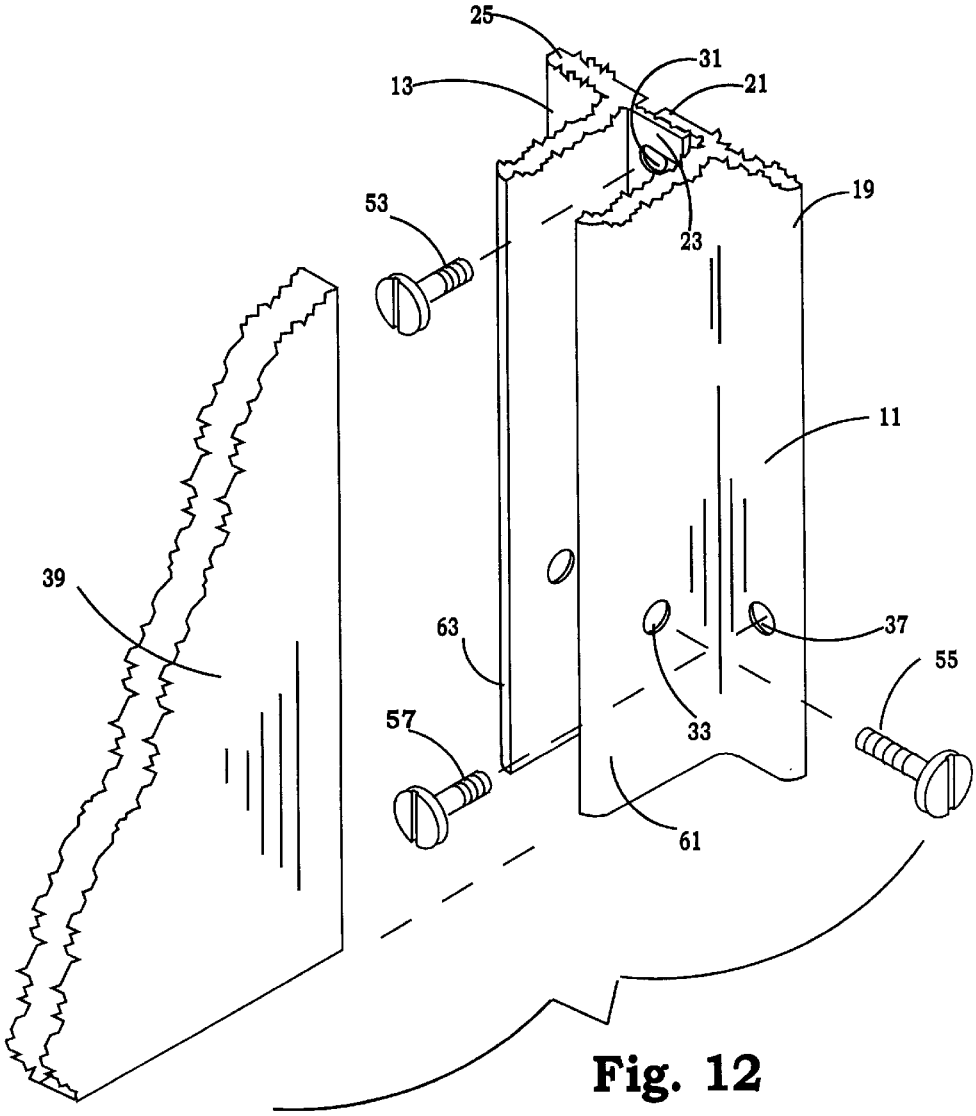
Fig. 12

REST ROOM PARTITION MOUNTING BRACKETS

SUMMARY OF THE INVENTION

The present invention relates generally to mounting brackets and more particularly to adjustable rest room hardware mounting brackets of the type which may be fastened to a wall or other surface to support dividers or panels in public rest rooms.

It is commonplace to find partitions or dividing panels in public rest rooms which are wall mounted so as to clear the floor by a foot or so and extending upwardly to approximately head height. Such arrangements facilitate cleaning while providing adequate privacy. Such partitions are commonly fastened to a wall by U-shaped mounting channels which are screwed, bolted, attached to fixed lugs, or otherwise fastened to the wall and which receive an edge portion of the panel within the U with the panel being held therein by additional screws, bolts, or the like. The screws fastening the channel to the wall may pass through attachment accepting openings located within the bottom of the U and be inaccessible when the partition is placed within the U. Alternately, the wall mounting screws may pass through attachment accepting openings located in outboard ears or tabs extending from the bottom of the U outwardly in one or both directions. In either of the later cases, additional mounting screws may be located within the interior bottom of the U. Such brackets are referred to as a U bracket, a single ear U bracket and a double ear U bracket respectively.

Rest Room partitions are available in a variety of thicknesses, ¾", ⅞", 1" and 1 ¼" thicknesses being common. Moreover, the hardware used to mount such partitions comes in a variety of configurations such as U bracket, single ear U bracket and double ear U bracket. The particular configuration used for an installation is partially determined by the mounting space available and the technique used to fasten the hardware to the wall.

There have been attempts to adapt a U-shaped bracket to more than one partition thickness. For example, the Birum, Jr. U.S. Pat. No. 3,447,186 fastens to a wall or ceiling to mount a removable panel using a fixed width concept with an optional compensating wedge, or a simple tightenable clamping structure. Also, an adjustable width feature for a door or window frame to adapt to various wall thicknesses using mating toothed sections is shown in the Boidron U.S. Pat. No. 4,787,184 and Kleyn U.S. Pat. No. 4,782,630.

Applicants' assignee manufactures rest room partition mounting brackets which are sliced to various lengths from extruded aluminum rails. Currently three different brackets, each in four different sizes are produced and sold requiring twelve different extrusions.

By extruding four bracket halves and overlapping the correct pair, all 12 can be made. Where the bracket halves overlap, there are a series of notches and a single protrusion on each bracket half which mate up at various discrete positions giving the desired wall thicknesses.

Among the several objects of the present invention may be noted the provision of a relatively large number of possible bathroom partition mounting brackets from a relatively small number of partition forming halves; the provision of an improved partition mounting technique; and overall improvements in the hardware and techniques of mounting partitions. These as well as other objects and advantageous features of the present invention will be in part apparent and in part pointed out hereinafter.

In general, a partition mounting bracket is formed from a pair of elongated bracket members, each of generally uniform cross-sectional configuration. The members are interlockable at any one of several selectable discrete locations along matable interlock strips, each having one protuberance and several grooves extending generally parallel to one another to form several different width generally U-shaped partition receiving channels. In addition to different possible widths, different configurations may be generated by selecting either a T-shaped cross-section or an L-shaped cross-section for each of the members.

BRIEF DESCRIPTION OF THE DRAWING

FIG. 1 is an end elevation view of one bracket member according to the present invention;

FIG. 2 is an end elevation view of a second bracket member;

FIG. 3 is an end elevation view of a third bracket member;

FIG. 4 is an end elevation view of a fourth bracket member;

FIG. 11*a* is an enlarged end view of the overlapping portion of the bracket members of FIGS. 1 or 3 FIG. 11*b* is an enlarged end view of the overlapping portion of the bracket members of FIGS. 2 or 4; and FIG. 12 is an exploded perspective view illustrating the joining of two bracket members to receive and support a partition.

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 7:
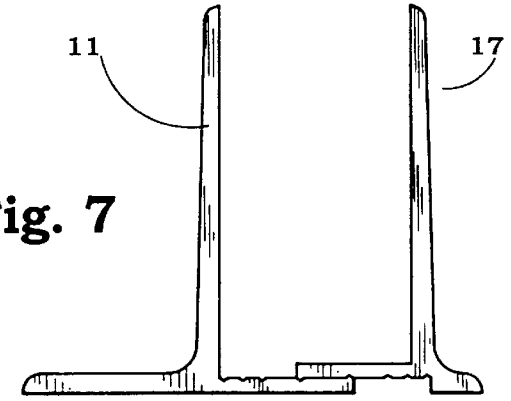
FIG. 7 is an end elevation view of a complete bracket formed from the bracket members of FIGS. 1 and 4.
Figure 8:
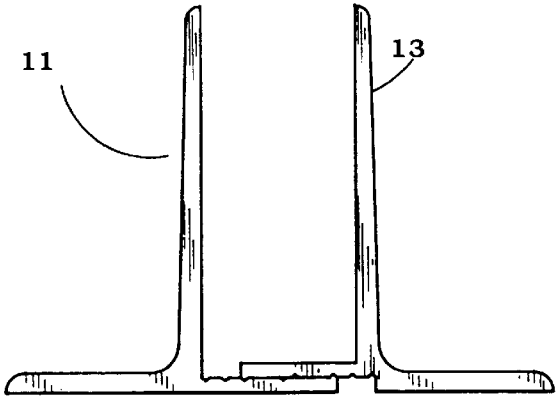
FIG. 8 is an end elevation view of a complete bracket formed from the bracket members of FIGS. 1 and 2.
Figure 9:
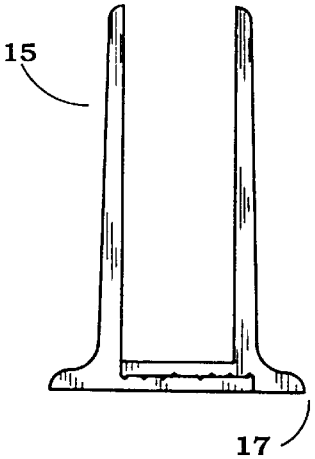
FIG. 9 is an end elevation view of a complete bracket formed from the bracket members of FIGS. 3 and 4.

Any of several (twelve in one preferred form) of partition mounting bracket may be created by selectively combining a pair of elongated bracket members 11, 13, 15 or 17. Each of these four bracket members or halves are of a generally uniform cross-sectional configuration. The several cross-sectional shapes are shown in FIGS. 1–4, 7, 8 and 9. Bracket halves 11 and 13 have an outboard ear portion 19 or 25 while bracket halves 15 and 17 have little or no ear. A complete bracket is created by combining members 11 and 17 to form a single ear U bracket as shown in FIG. 7; members 11 and 13 to form a double ear U bracket as depicted in FIG. 8; or members 15 and 17 to form a simple "earless" U bracket as seen in FIG. 9. Not all twelve of the possible selections of two bracket halves from the four shown are useful. One selection must have the interlock strip facing upwardly as in FIGS. 1, 3 and 11*a*. Of these, bracket half 11 is generally T-shaped in cross-section and the other bracket half 15 generally L-shaped in cross-section. The other bracket half selected, again, either a T-shaped or an L-shaped cross-section, must have a matable interlock strip facing downwardly as in FIGS. 2, 4 and 11*b*.

The selected pair of members may be joined to create a generally U-shaped partition receiving channel with any of several (four as illustrated) selectable spacings or widths between the channel sidewalls. Each bracket member includes an interlock strip such as 21, 23 and 27 which are shown in greater detail in FIGS. 11*a* and 11*b*. The interlock strips of the pair of members overlap when the members are joined at any one of the selectable discrete locations to form a bottom central portion of the U. Each interlock strip has one protuberance or longitudinally extending rib 49 or 51 and a plurality (four as illustrated) of grooves such as 41, 43, 45, 47 and 59 which extend generally parallel to one another in the direction of elongation. The most narrow partition thickness is accommodated by the bracket of FIG. 9 where protuberance 51 engages groove 41 and protuberance 49 engages groove 59. Wider spacing between the channel walls is achieved in FIG. 8 where protuberance 49 engages groove 47. In general, the widths which may be accommodated is determined by the number and locations of the grooves.

Figure 6:
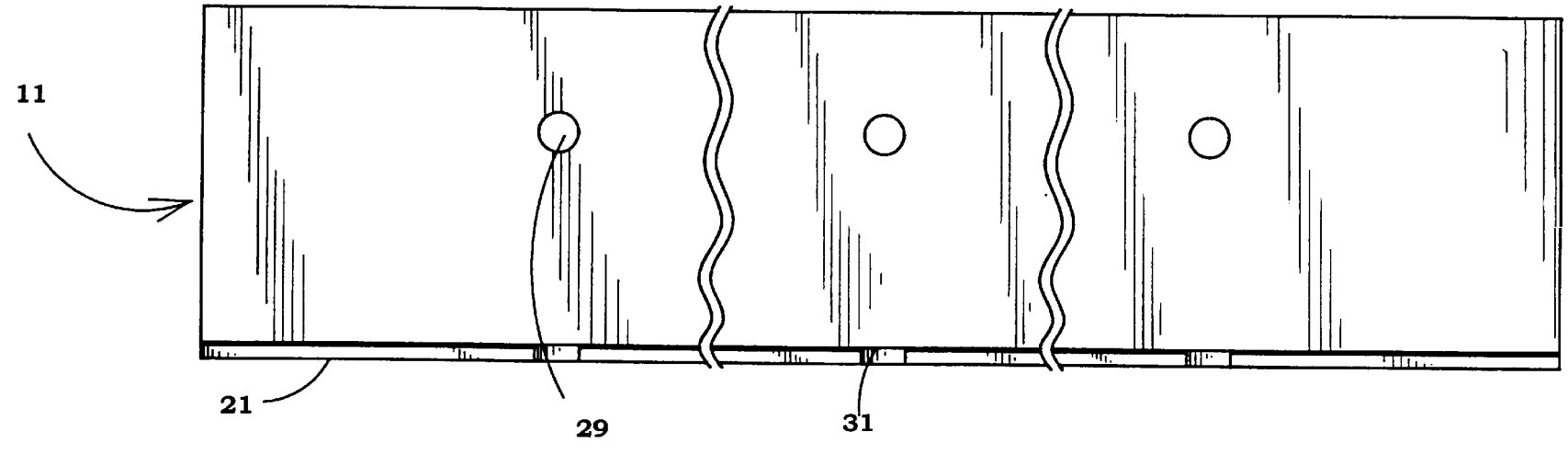
FIG. 6 is a side elevation view of the bracket member of FIG. 1 from the right side thereof.
Figure 5:
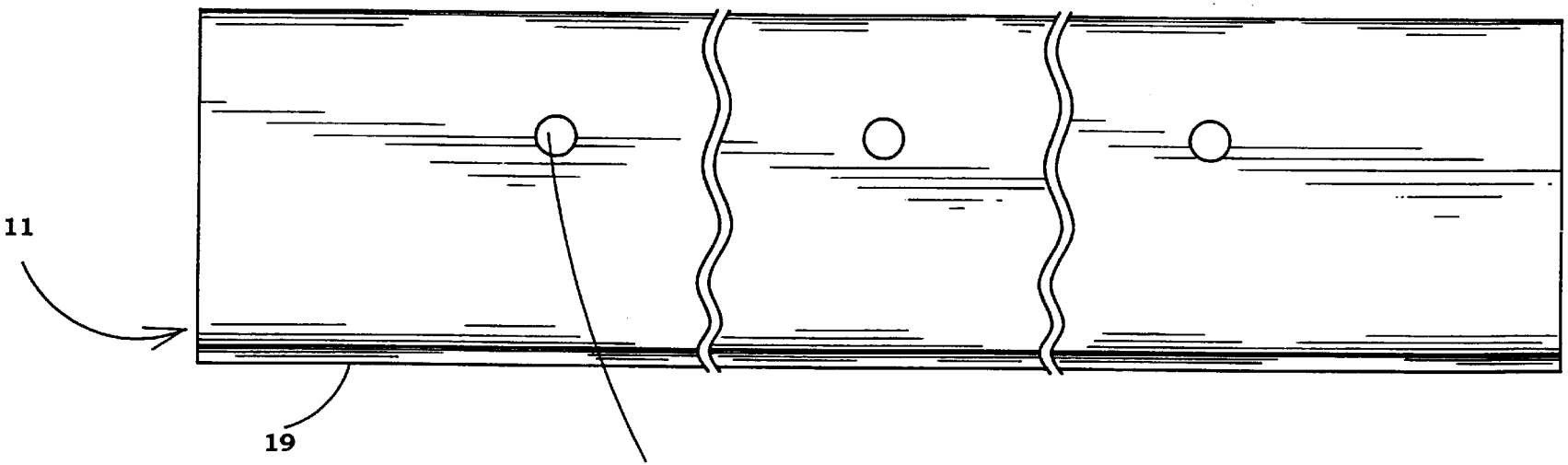
FIG. 5 is a side elevation view of the bracket member of FIG. 1 from the left side thereof.
Figure 10:
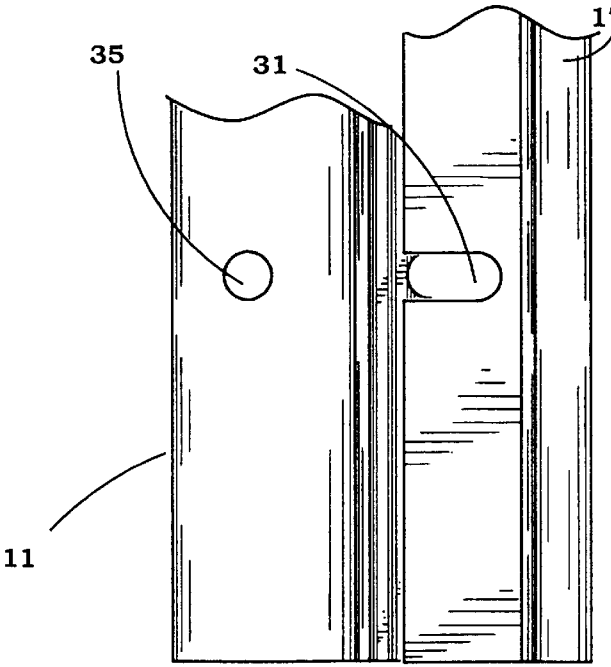
FIG. 10 is a front elevation view of the complete bracket of FIG. 7.

FIG. 10 is a front elevation view of the complete bracket utilizing bracket halves 11 and 17 joined as in FIG. 7 and revealing several features common to several of the bracket halves. Bracket halves 11 and 13 have periodically spaced mounting holes such as 35 and 37 extending along the outer ear portion 19 or 25. All of the bracket halves have periodically spaced mounting notches such as 31 formed in the interlock strip. These notches are generally U-shaped and align when two bracket halves are joined to form periodically spaced mounting screw receiving openings within the partition receiving opening of the bracket. These periodically spaced attachment accepting openings 31 are generally circular when the members are interlocked at the close spacing of FIG. 9 and are elongated as illustrated in FIG. 10 with a pair of semicircular ends and a pair of parallel straight sides when the members are interlocked as in FIGS. 7 or 8. The attachment accepting openings described so far are for affixing the bracket to a wall or other building surface, however, additional openings which serve to fasten a partition to the bracket are shown in FIGS. 5 and 6. In FIG. 5 which is a side elevation view of the bracket member 11 of FIG. 1 from the left side, the channel wall includes openings such as 29 and 33. In FIG. 6 which is a side elevation view of the bracket member 11 of FIG. 1 from the right side, both the channel wall openings such as 29 and 33 and the U-shaped notches in the interlock strip 21 are visible. Again, such openings are common to all the bracket halves described.

The technique utilizing the bracket members for installing a bathroom partition will be described with reference primarily to FIG. 12. A first elongated bracket member such as 11 is selected from any of two different bracket members 11 or 15 having an upwardly facing interlock strip. Of course, each of these bracket halves has a generally flat elongated channel wall such as 61 and a generally flat elongated interlock strip 21 extending generally orthogonal to the channel wall. The illustrated selected bracket half 11 also has the outboard ear-forming strip 19 extending generally orthogonal to the channel wall. A second elongated bracket member such as 13, this time having a downwardly facing interlock strip 23, is similarly selected. The selected bracket members are next juxtaposed generally parallel to one another with the interlock strips 21 and 23 overlapped and with the channel walls 61 and 63 extending generally parallel to and spaced from one another a distance to accommodate the partition 39. The selected bracket members 11 and 13 are now united to fix the preferred spacing by fastening the assembled bracket, for example, by screws such as 53 to a bathroom wall. Additional screws such as 57 passing through ear openings such as 37 may also be employed in fixing the bracket to a wall. The edge of partition 39 is then introduced into the space between the channel walls 61 and 63 and fastened to at least one of the channel walls as by screws such as 55.

From the foregoing, it is now apparent that a novel rest room partition mounting arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A partition mounting bracket comprising a pair of elongated bracket members, each of generally uniform cross-sectional configuration, the members being interlockable at any one of at least two selectable discrete locations to form a corresponding one of any one of at least two dissimilar width generally U-shaped receiving channels, wherein each of the pair of bracket members includes an interlock strip having one protuberance and at least two grooves extending generally parallel to one another in the direction of elongation, the members being interlockable at a first of the at least two locations with each protuberance of one member engaging a first of the two grooves of the other member, and the members being interlockable at a second of the least two locations with each protuberance of one member engaging a second of the two grooves of the other member, and wherein each of the interlock strips includes a plurality of periodically spaced U-shaped notches along an edge thereof, the notches of one member aligning with the notches of the other member when the members are interlocked to form periodically spaced attachment accepting openings.

2. The partition mounting bracket of claim 1 wherein one member is selected from any of two different bracket members, one being generally T-shaped in cross-section and the other being generally L-shaped in cross-section and the other member is selected from any of two additional different bracket members, one being generally T-shaped in cross-section and the other being generally L-shaped in cross-section.

3. The partition mounting bracket of claim 1 wherein the periodically spaced attachment accepting openings are generally circular when the members are interlocked at a first of the at least two locations and the attachment accepting openings are elongated with a pair of semicircular ends and a pair of parallel straight sides when the members are interlocked at a second of the at least two locations.

4. The partition mounting bracket of claim 1 wherein the interlock strips of the pair of members overlap when the members are joined at any one of at least two selectable discrete locations to form a bottom central portion of the U.

5. The method of installing a bathroom partition comprising the steps of:

selecting a first elongated bracket member from any of two different bracket members each having a generally flat elongated channel wall and a generally flat elongated interlock strip extending generally orthogonal to the channel wall;

selecting a second elongated bracket member from any of two additional different bracket members each having a generally flat elongated channel wall and a generally flat elongated interlock strip extending generally orthogonal to the channel wall;

juxtaposing the selected first and second bracket members generally parallel to one another with the interlock strips thereof overlapped and with the channel walls thereof extending generally parallel to and spaced a preferred distance from one another;

uniting the selected first and second bracket members to fix the preferred distance;

fastening the bracket members to a bathroom wall;

inserting a partition edge into the space between the channel walls; and fastening the partition to at least one of the channel walls.

6. The method of claim 5 wherein the step of uniting and the step of fastening are performed simultaneously by passing at least one threaded fastener through both interlock strips.

7. The method of claim 5 wherein one of the two different bracket members is generally T-shaped in cross-section and the other is generally L-shaped in cross-section and one of the two additional different bracket members is generally T-shaped in cross-section and the other is generally L-shaped in cross-section, the steps of selecting first and second elongated bracket members further comprising exactly one of:

selecting a T-shaped first elongated bracket member and selecting a T-shaped second elongated bracket member to thereby form a double ear U bracket;

selecting a T-shaped first elongated bracket member and selecting an L-shaped second elongated bracket member to thereby form a single ear U bracket; and selecting an L-shaped first elongated bracket member and selecting an L-shaped second elongated bracket member to thereby form a simple U bracket.

* * * * *

UNITED STATES PATENT AND TRADEMARK OFFICE

CERTIFICATE OF CORRECTION

PATENT NO. : 5,881,517

DATED : March 16, 1999

INVENTOR(S) : Robert G. Prince and Scott A. Colley

It is certified that error appears in the above-identified patent and that said Letters Patent is hereby corrected as shown below:

Column 2

Line 34, the word "FIG. 11b" should start a new paragraph.

Column 3

Line 41, the word "The" should start a new paragraph.

Signed and Sealed this

Twenty-seventh Day of July, 1999

*Attest:*

Q. TODD DICKINSON

*Attesting Officer*

*Acting Commissioner of Patents and Trademarks*